United States Patent [19]

Oliphant

[11] Patent Number: 4,781,290

[45] Date of Patent: Nov. 1, 1988

[54] COIN HOLDING DEVICE

[76] Inventor: Norman D. Oliphant, 16820 SW. Allen Rd., Lake Oswego, Oreg. 97034

[21] Appl. No.: 912,389

[22] Filed: Sep. 26, 1986

[51] Int. Cl.[4] ..... A45C 11/28

[52] U.S. Cl. ..... 206/0.83; 206/0.84; 220/4 E

[58] Field of Search ..... 206/0.8, 0.81, 0.82, 206/0.83, 0.84; 220/4 E, 336

[56] References Cited

U.S. PATENT DOCUMENTS

| | | | |
|---|---|---|---|
| 151,433 | 5/1874 | Redding | 220/336 |
| 2,358,194 | 9/1944 | White | 220/336 |
| 2,388,442 | 11/1945 | Reyburn | 220/336 |
| 2,539,648 | 1/1951 | Wink | 206/0.84 |
| 2,949,951 | 8/1960 | Schoen | 220/336 |
| 2,999,611 | 9/1961 | Paulson | 220/4 E |
| 3,277,904 | 10/1966 | Sparr | 206/0.83 |
| 3,763,994 | 10/1973 | Somers | 206/387 |
| 3,909,088 | 9/1975 | Dennehey et al. | 206/387 |
| 3,937,352 | 2/1976 | Kalous | 220/4 E |
| 4,143,765 | 3/1979 | Moss, III | 206/0.83 |
| 4,196,806 | 4/1980 | Posso | 206/387 |
| 4,513,974 | 4/1985 | Lin | 220/336 |

*Primary Examiner*—Joseph Man-Fu Moy
*Attorney, Agent, or Firm*—Stoel Rives Boley Jones & Grey

[57] ABSTRACT

A device for compactly storing coins of different denominations from which the coins can be readily retrieved when required. The device comprises a casing having an interior chamber, a tray for holding coins which is adapted to fit inside the chamber of the casing, and a mechanism for allowing the tray to be pivoted into and out of the chamber in the casing. Coins are placed in the tray and the tray is pivoted into the casing for storing the coins. The tray is pivoted out of the casing for access to the coins when they are needed.

2 Claims, 2 Drawing Sheets

FIG. 5D
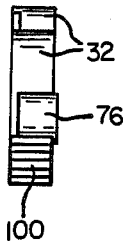
FIG. 5A
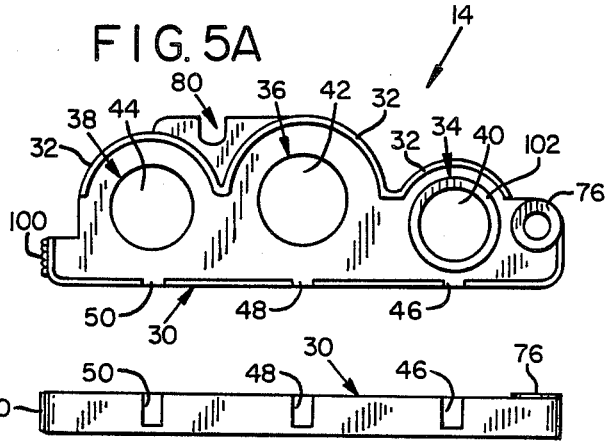
FIG. 5C
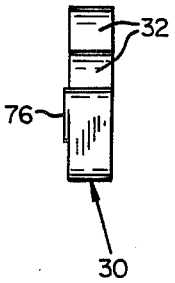
FIG. 5B
FIG. 4B
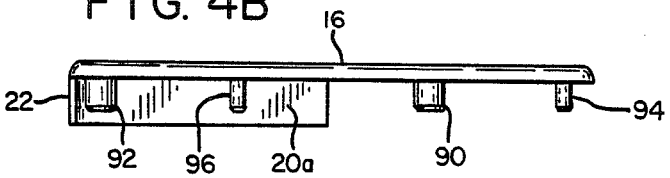
FIG. 4D
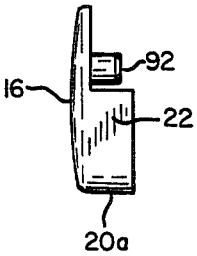
FIG. 4A
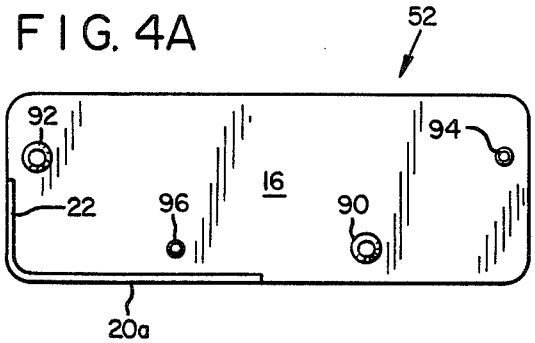
FIG. 4C
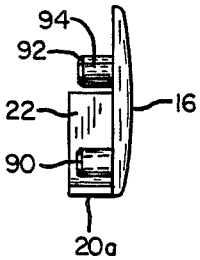

COIN HOLDING DEVICE

BACKGROUND OF THE INVENTION

The present invention relates to devices for holding coins so that they are conveniently stored and yet are readily accessible for use.

In the past, coins have generally been stored in cloth or leather purses having sets of locking jaws which function as a closure for the device. However, such purses allow the coins to move freely within them; consequently, the coins can create rattling noises when the purse is carried by the user. Moreover, coins carried in such purses are not in any way arranged for convenient use according to their denominations. Alternately, coins have been stored in spring-loaded stacks within small cylinders or barrels or in an edge-to-edge fashion within elongated slot structures which retain the coins in place by gripping them along opposite edges. However, these devices have generally proven to be inconveniently bulky for carriage within a pocket of the user's clothing.

SUMMARY OF THE INVENTION

The present invention provides an apparatus for conveniently storing coins from which the coins can be quickly accessed and dispensed when needed. Additionally, the apparatus retains the coins in fixed positions to minimize rattling and allows the coins to be arranged in accordance with their denominations. Further, the present invention constitutes a device which is compact in design so that it can be comfortably carried within a pocket of the user's clothing.

More specifically, the invention comprises a rigid body or casing, a coin tray, and a pivot mechanism. The rigid body or casing is of generally rectangular shape and has a chamber inside thereof and an opening which communicates between the chamber and the exterior of the body. The coin tray includes a set of depressions for holding different sized coins and is adapted to fit within the chamber. The pivot mechanism is located at one end of the chamber and at one end of the coin tray and allows for the coin tray to be pivotally slid in and out of the chamber.

The device functions to allow coins to be placed in or removed from the depressions in the coin tray when the tray is pivoted out from the chamber and the device is open. The device also functions to conveniently store coins deposited therein when the tray is pivoted into the chamber and the device is closed.

BRIEF DESCRIPTION OF THE DRAWINGS

FIGS. 4A–4D are top, front, and right end, and left end views, respectively, of one half of the structure used to form the rigid body or casing component of the embodiment of the present invention illustrated in FIG. 1.

FIGS. 5A–5D are top, front, and right and left end views, respectively, of the coin tray component of the embodiment of the present invention illustrated in FIG. 1.

Description of the Preferred Embodiment

Figure 1:
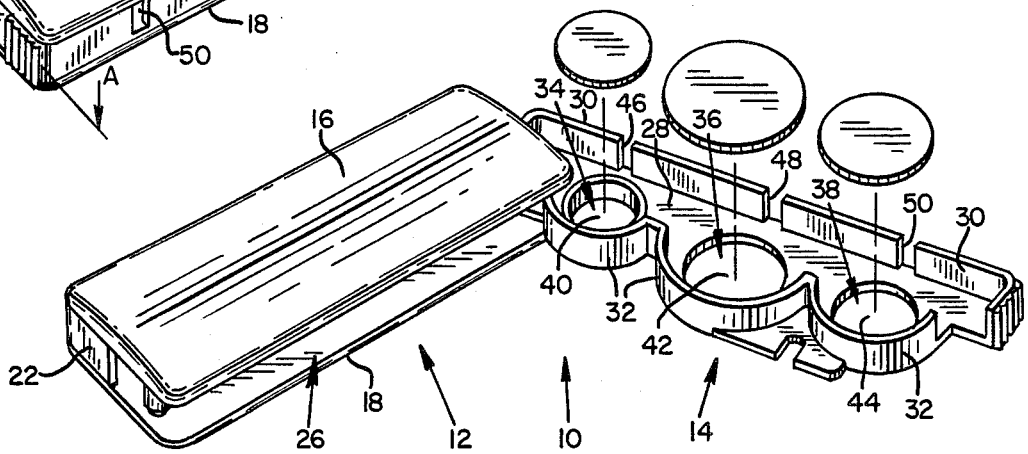
FIG. 1 is a perspective view of one embodiment of the present invention in the open position.

Referring now to FIG. 1 the present invention comprises the coin holding apparatus 10 which is shown in the open position and includes a rectangular-shaped body or casing 12 and a coin tray 14. The body 12 includes a top wall 16 and a substantially parallel bottom wall 18 which in combination with a back wall 20 (not shown in FIG. 1) and the two side walls 22 and 24 (also not shown in FIG. 1) define a chamber 26 within the interior of the body 12. The coin tray 14 includes a floor 28, a front face 30, and a back face 32 having three arcuate sections which cooperate to define three circular depressions 34, 36, and 38 of different sizes for holding coins of different denominations, namely, dimes, quarters, and nickels, respectively. The depressions 34, 36, and 38 all have circular openings 40, 42, and 44 of lesser diameters than those of the coins to be stored in the depressions. The openings are located along the floor 28 in the bottoms of the depressions 34, 36, and 38 and function to assist the user in removing coins from the tray 14 by allowing the coins to be poked up and out of the depressions 34, 36, and 38 from underneath the tray 14. The apparatus 10 and its components are preferably constructed of conventional plastic materials which may be formed to the required shapes in accordance with standard injection molding practices.

The coin tray 14 additionally includes three slits 46, 48, and 50 in the front face 30 which are located directly across from the centers of the depressions 34, 36, and 38 and which function to allow the user to view the number of coins in each depression when the apparatus 10 is closed. The coin tray 14 is constructed and arranged to fit within the confines of the chamber 26 and to be able to pivotally slide into and out of the chamber 26. For this purpose the width, length, and height of the tray 14 all match the corresponding interior dimensions of the chamber 26.

Figure 2A:
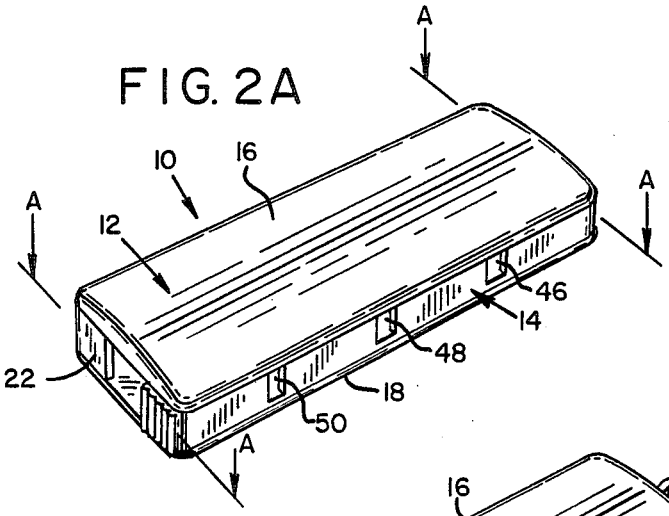
FIGS. 2A–2B are perspective and exploded perspective views, respectively, of the embodiment of the present invention illustrated in FIG. 1 in the closed position.
Figure 2B:
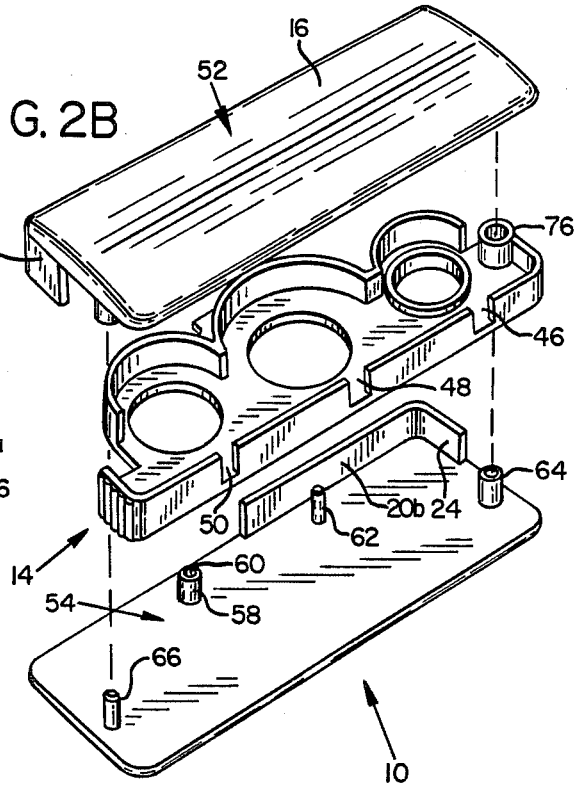

Referring now to FIGS. 2A and 2B, the positioning of the coin tray 14 within the body 12 is illustrated when the apparatus 10 is in the closed position. In FIG. 2A, it is shown how the coin tray 14 fits closely within the chamber 26 and body 12 so that the front face of the tray 14 is flush with the front edges of the walls 16 and 18 and the apparatus 10 is formed into a compact package which can be easily and comfortably carried within a pocket of a user's clothing. The slits 46, 48, and 50 allow the user to readily view the number of coins stored within the apparatus 10.

In FIG. 2B the details of the positioning of the coin tray 14 between the top and bottom sections of the body is shown. When the apparatus 10 is closed, the top wall 16 functions to retain the coins within the coin tray 14 regardless of the orientation of the apparatus 10. The body 12 is also shown to be composed of two identical halves 52 and 54 which are secured together by connecting posts at four different points. Each half 52 or 54 includes parts which are complementary to parts provided by the other half. In the present case, top half 52 provides top wall 16, side wall 22, and one half of back wall 20*a* (not shown in FIG. 2B) while bottom half 54 provides bottom wall 18, side wall 24, and one half of back wall 20*b*. The connecting posts are likewise comprised of two matching parts. Each post includes a stub, such as 58 having a circular cavity 60 centrally disposed therein, and includes a round projection, such as 62 which mates with the cavity 60. Each half includes two projections and two stubs. In the present case the bottom half 54 furnishes projections 62 and 66 and stubs 58 and 64. The connecting posts are formed when corresponding projections and stubs on different halves are mated together and cemented in place.

Figure 3:
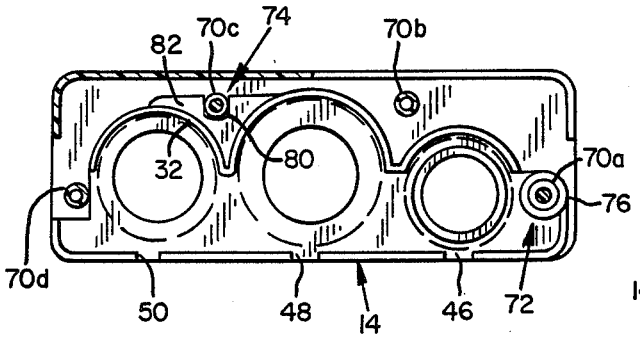
FIG. 3 is a cross-sectional view of the embodiment of the present invention illustrated in FIG. 2 along lines A—A of FIG. 2A.

Referring now to FIG. 3, a cross section of the apparatus 10 is illustrated showing details of the construction of the connecting posts 70*a–d* the pivot or hinge mechanism 72 and the locking mechanism 74. The connecting posts 70*a–d* each comprise a projection mated to and fitted within a matching stub. The pivot mechanism 72 includes the connecting post 70*a* at one end of the body or casing 12 which functions as a pivot post and the bearing 76 at one end of the tray 12 which is concentric with the post 70*a* for allowing the tray 14 to rotate around the post 70*a* . The post 70*a* and bearing 76 provide the means for the tray to pivotally slide into and out of the chamber 26 in the body 12. The locking mechanism 74 includes the connecting post 70*c* and the slot 80 cut into the plate 82 attached to the back face 32 of the tray 14. The slot 80 frictionally engages the post 70*c* for assisting in retaining the coin tray 14 within the chamber of the body.

Referring now to FIGS. 4A–4D, various views of one of the halves 52 which comprise the body or casing 12 are illustrated These views further depict the structure and positioning of the stubs 90 and 92, the projections 94 and 96, the top wall 16, the back wall 20*a* and the side wall 22. Also, FIGS. 4C and 4D show the curved shape of the wall 16 formed so as to be thicker toward its center than around its periphery thereby providing a more comfortable shape for handling by the user.

Referring now to FIGS. 5A–5D various views of the coin tray 14 of one embodiment of the present invention are shown. These views further illustrate the structure and positioning of the front face 30, the back face 32, the floor 28, the slits 46, 48, and 50, the depressions 34, 36, and 38, the openings 40, 42, and 44 the slot 80 (of the locking mechanism) and the bearing 76 (of the pivoting mechanism). Also, these views illustrate the serrated edge 100 on the end of the tray 14 opposite the bearing which functions to provide a grip for the user to utilize in pulling the tray 14 out from the body 12, and the circular ledge 102 which extends up from the bottom of the depression 34 for helping to more closely confine the thinner coins (dimes) which are deposited in this depression.

As may be apparent from the preceding description, certain changes may be made in the above constructions without departing from the scope of the invention. Therefore, the embodiment described and the drawings are intended to be illustrative in nature and are not meant to be interpreted as limiting the following claims.

I claim:

1. A coin holding apparatus comprising:

a casing including two identical halves secured together by a plurality of connecting posts for forming a body having a chamber and an opening to said chamber;

a coin tray including a set of coin holding depressions which is adapted to fit in and slide into and out of said body through said opening; and a pivot means connected to said body and said coin tray for allowing said tray to pivot into and out of said body.

2. The apparatus of claim 1, wherein:

said connecting posts each include a projection which is attached to one of said halves and a matching stub having a cavity into which said projection may extend which is attached to the other of said halves.

* * * * *